US010760220B2

(12) United States Patent
Pal et al.

(10) Patent No.: US 10,760,220 B2
(45) Date of Patent: Sep. 1, 2020

(54) PACKAGING MATERIAL AND METHOD FOR MAKING THE SAME

(71) Applicant: Hewlett-Packard Development Company, L.P., Spring, TX (US)

(72) Inventors: Lokendra Pal, San Diego, CA (US); Xulong Fu, San Diego, CA (US); Xiaoqi Zhou, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/261,537

(22) Filed: Jan. 29, 2019

(65) Prior Publication Data

US 2019/0153676 A1 May 23, 2019

Related U.S. Application Data

(62) Division of application No. 15/122,039, filed as application No. PCT/US2014/035138 on Apr. 23, 2014, now abandoned.

(51) Int. Cl.
*D21H 27/10* (2006.01)
*D21H 17/66* (2006.01)
(Continued)

(52) U.S. Cl.
CPC ..... *D21H 27/10* (2013.01); *D21F 9/02* (2013.01); *D21H 17/66* (2013.01); *D21H 27/38* (2013.01)

(58) Field of Classification Search
CPC ..... D21H 27/38; D21H 27/30; D21H 17/66; D21H 1/02; D21H 27/10; D21F 11/04;
(Continued)

(56) References Cited

U.S. PATENT DOCUMENTS 1,961,365 A 6/1934 De Witt et al.
2,234,457 A 3/1941 Strovink
(Continued)

FOREIGN PATENT DOCUMENTS

DE 2310445 A1 * 9/1973 ..... D21F 11/04
DE 4031038 A1 * 4/1992 ..... D21F 9/006
(Continued)

OTHER PUBLICATIONS

International Search Report and Written Opinion for International Application No. PCT/US2014/035138 dated Jan. 19, 2015, 10 pages.

*Primary Examiner* — Jose A Fortuna
(74) *Attorney, Agent, or Firm* — Dierker & Kavanaugh PC

(57) ABSTRACT

A method for making a packaging material includes jetting a first pulp stock onto a wire to form a strength layer precursor including water; and softwood fibers, the first pulp stock excluding a water soluble di-valent or multi-valent salt. A second pulp stock is jetted onto a second wire to form an image layer precursor including water; hardwood fibers; and a water soluble di-valent or multi-valent salt present in an amount ranging from about 5 lb per ton of total fibers in the second pulp stock to about 50 lb per ton of the total fibers in the second pulp stock. The image layer precursor and the strength layer precursor are placed in contact. Water is removed from the image and strength layer precursors. The image layer precursor and the strength layer precursor are dried to form the packaging material including an image layer and a strength layer.

15 Claims, 2 Drawing Sheets

(51) Int. Cl.
*D21F 9/02* (2006.01)
*D21H 27/38* (2006.01)

(58) Field of Classification Search
CPC ..... D21F 9/02; B32B 29/005; B32B 2250/03; B32B 2250/26; Y10T 428/24612
See application file for complete search history.

(56) References Cited

U.S. PATENT DOCUMENTS 2,286,924 A * 6/1942 Nicholson ..... D21F 11/04 162/124
2,942,661 A * 6/1960 Beachler ..... D21F 3/10 162/304
3,752,734 A * 8/1973 Notbohm ..... D21F 11/04 162/123
3,891,501 A * 6/1975 Oka ..... D21F 11/04 162/290
4,071,651 A 1/1978 Hicklin et al.
4,830,709 A * 5/1989 Turner ..... D21F 9/006 162/133
4,892,590 A 1/1990 Gill et al.
5,055,161 A 10/1991 Hoffman
5,064,502 A * 11/1991 Turner ..... D21F 11/04 162/299
5,851,352 A 12/1998 Vinson et al.
5,916,417 A 6/1999 Cassidy et al.
6,068,732 A 5/2000 Cassidy et al.
6,342,125 B1 * 1/2002 Nordstrom ..... D21F 11/04 162/132
6,364,997 B1 4/2002 Dagan et al.
6,537,680 B1 3/2003 Norlander et al.
6,669,814 B2 12/2003 Hansen et al.
7,070,854 B2 7/2006 Chang et al.
7,608,165 B2 * 10/2009 Raisanen ..... D21F 9/02 162/132
7,771,804 B2 8/2010 Ogata et al.
8,585,866 B2 * 11/2013 Mikami ..... D21F 1/0063 162/202
8,608,906 B2 12/2013 Laleg et al.
9,278,569 B2 3/2016 Pal et al.
9,840,812 B2 10/2017 Miller, IV et al.
2002/0060005 A1 * 5/2002 Mohan ..... D21G 1/006 162/123
2003/0111198 A1 6/2003 Hu
2003/0168191 A1 9/2003 Hansen et al.
2005/0000665 A1 1/2005 Doelle
2005/0034826 A1 2/2005 Hu
2006/0001725 A1 1/2006 Nagata et al.
2006/0065379 A1 3/2006 Babcock et al.
2006/0115633 A1 6/2006 Steichen et al.
2007/0187055 A1 8/2007 Manifold et al.
2007/0202347 A1 8/2007 Meazle et al.
2009/0056892 A1 3/2009 Rekoske et al.
2009/0074996 A1 3/2009 Ogata et al.
2009/0165973 A1 * 7/2009 Aula ..... D21F 9/006 162/133
2010/0038266 A1 2/2010 Haellstroem et al.
2011/0177264 A1 7/2011 Kawai
2012/0114917 A1 5/2012 Anderson et al.
2012/0144611 A1 6/2012 Baker et al.
2013/0029105 A1 1/2013 Miller et al.
2013/0235118 A1 9/2013 Zhou et al.
2013/0306259 A1 11/2013 Fu et al.
2014/0139601 A1 5/2014 Pal et al.
2016/0289897 A1 10/2016 Ramaratnam et al.
2017/0073902 A1 * 3/2017 Pal ..... D21H 27/10
2017/0247841 A1 8/2017 Benz et al.
2017/0292224 A1 10/2017 Miller, IV et al.
2017/0328012 A1 11/2017 Lee et al.
2018/0009252 A1 1/2018 Zhou et al.
2018/0155875 A1 6/2018 Ankerfors et al.
2019/0153676 A1 * 5/2019 Pal ..... D21H 27/38
2020/0180338 A1 * 6/2020 Zhou ..... B41M 5/506

FOREIGN PATENT DOCUMENTS

DE 10043901 4/2001
DE 19951928 A1 * 5/2001 ..... D21F 9/02
EP 0279617 A2 * 8/1988 ..... G03C 1/775
EP 0851058 A2 * 7/1998 ..... D21F 1/48
EP 1775141 4/2007
EP 2640894 7/2016
GB 1387109 A * 3/1975 ..... D21F 11/04
JP 2000118155 4/2000
JP 2006219775 8/2006
WO WO-9848111 A1 * 10/1998 ..... D21F 9/006
WO WO-2012067615 5/2012
WO WO-2012134455 10/2012
WO WO-2012148405 11/2012
WO WO-2014011141 1/2014

* cited by examiner

PACKAGING MATERIAL AND METHOD FOR MAKING THE SAME

CROSS-REFERENCE TO RELATED APPLICATIONS

This application is a divisional of U.S. application Ser. No. 15/122,039, filed Aug. 26, 2016, which is itself a 35 U.S.C. 371 national stage filing of International Application S.N. PCT/US2014/035138, filed Apr. 23, 2014, both of which are incorporated by reference herein in their entireties.

BACKGROUND

Packaging materials may be made on a papermaking machine, such as a Fourdrinier Machine. Papermaking generally involves forming a web of fibers on a conveyer belt (often referred to as a wire), pressing the fibers to drain water from the web, and then drying the pressed web. The papermaking process may also include calendering, where a roll is used to smooth the dried web.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the packaging material disclosed herein include a multi-layered structure with a di-valent or multi-valent salt present (e.g., distributed) throughout an image layer, which is positioned as at least one of the outermost layers of the structure. Examples of the multi-layered structure also include a strength layer. It is believed that the image layer enhances the print quality characteristics of the multi-layered structure, and the strength layer enhances the durability of the multi-layered structure.

The di-valent or multi-valent salt remains in the image layer, at least in part because the strength layer includes softwood fibers of a specific length that form a fiber mat with relatively low porosity that acts as a barrier to the salt. This fiber mat reduces salt migration from the image layer through the strength layer during the papermaking process. The presence of the salt in the outermost image layer(s) is desirable for enhancing the compatibility of the packaging material with inkjet inks subsequently printed thereon. The salt provides the packaging material with an ink fixing characteristic.

Additionally, the methods for making the packaging material disclosed herein are streamlined, in part because the salt may be added to the image layer during the forming process. As such, additional offline coating and/or printing processes are not required. The methods disclosed herein enable a traditional papermaking machine (e.g., a paperboard duo Fourdrinier machine having multiple headboxes) to be used, even when the machine does not include a surface sizing station.

Figure 1:
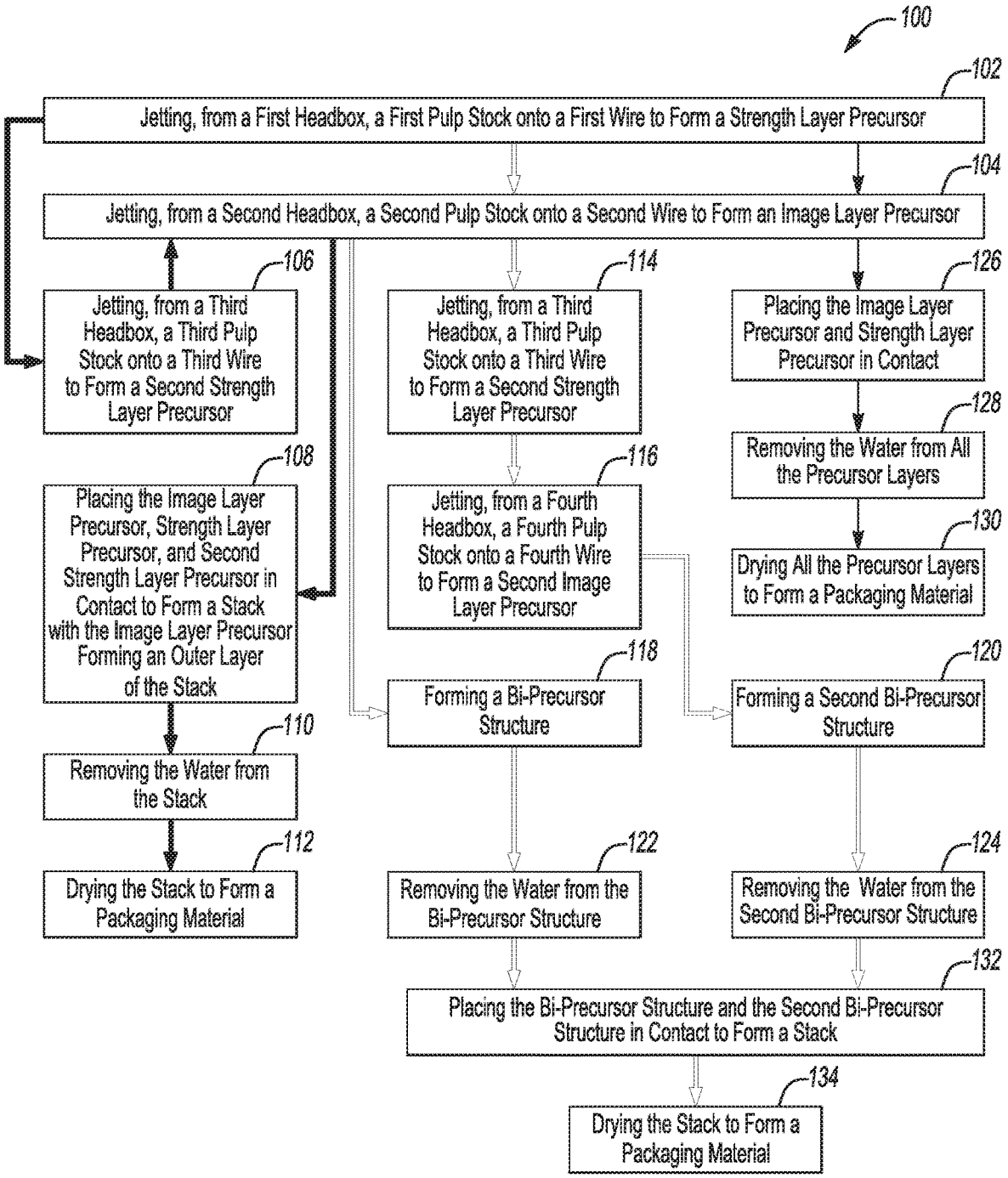
FIG. 1 is a flow diagram depicting several examples of a method for making a packaging material.
Figure 2:
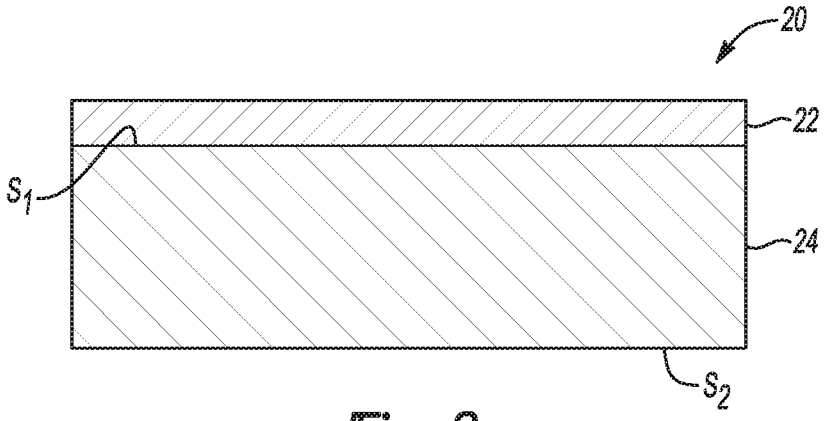
FIG. 2 is a cross-sectional view depicting an example of the packaging material including an image layer and a strength layer.
Figure 3:
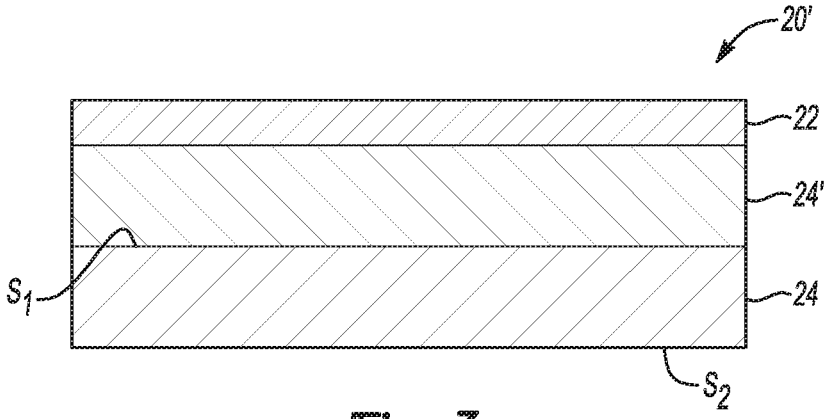
FIG. 3 is a cross-sectional view depicting another example of the packaging material including the image layer in contact with one opposed surface of the strength layer and a second strength layer in contact with another opposed surface of the strength layer.
Figure 4:
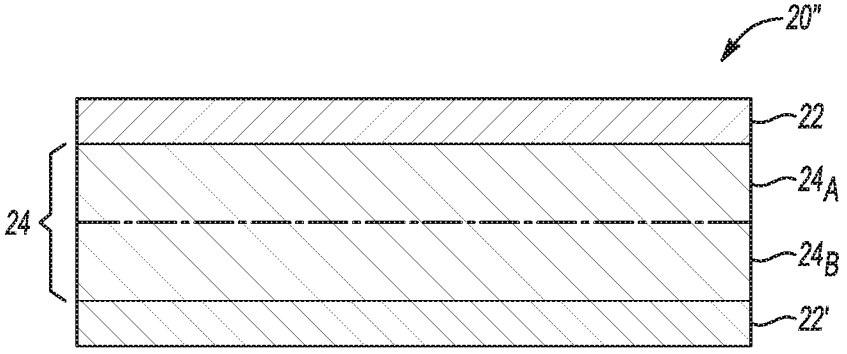
FIG. 4 is a cross-sectional view depicting yet another example of the packaging material including the strength layer made up of two sub-strength layers and respective image layers in contact with outer opposed surfaces of the strength layer.

Referring now to FIG. 1, the steps of various examples of the method 100 for making examples of the packaging material are illustrated. Different examples of the method 100 are denoted by the different arrows between the boxes. For example, one example of the method is shown by the bold arrows, and includes steps 102 through 112. Examples of the resulting packaging materials are shown in FIG. 2 through FIG. 4. The specific layered structures shown in FIG. 2 through FIG. 4 will be described throughout the discussion of FIG. 1.

While not shown in FIG. 1, at the outset of any of the examples of the method, suitable pulps stocks are formed for the image layer(s) and the strength layer(s). All of the pulp stocks described in conjunction with the method(s) disclosed herein initially contain water along with at least one type of fiber for making a particular layer. It is to be understood that when the pulp stock is dried, there may be some minimal loss of the fiber(s) in the final layer that is formed.

Examples of the pulp stock for the image layer(s) include about 99% water. The remaining components in the image layer(s) pulp stocks are the hardwood fibers, and the salt. In some instances, no other components are added. In other instances, other fibers and/or additives may be included in the image layer pulp stock.

The hardwood fibers included in the image layer pulp stock have an average length ranging from about 0.5 mm to about 1.5 mm. These relatively short fibers improve the formation and smoothness of the packaging material. In addition, it is believed that ink applied to an image layer including relatively short fibers may be distributed more precisely. The hardwood fibers are present in an amount ranging from about 70 wt % to about 100 wt % of a total wt % of the solid components (i.e., total solids wt %) of the image layer pulp stock. In an example, suitable hardwood fibers include pulp fibers derived from deciduous trees (angiosperms), such as birch, aspen, oak, beech, maple, and eucalyptus. The hardwood fibers may be bleached or unbleached hardwood fibers.

When the image layer pulp stock includes less than 100 wt % of the hardwood fibers previously defined, the pulp stock may also include up to 20 wt % of fibers other than the hardwood fibers. These other fibers may be a different type of fiber from, but have the same length as, the hardwood fiber. The other fibers may be natural fibers, virgin fibers, recycled fibers, non-deinkable fibers, unbleached fibers, synthetic fibers, mechanical fibers, or combinations thereof. One example of the other fibers includes softwood fibers.

The hardwood fibers and/or other fibers may be prepared by any known pulping process, such as, for example, chemical pulping processes. Two suitable chemical pulping methods include the kraft process and the sulphite process. The hardwood fibers may also be mechanically pulped, thermomechanically pulped, or chemi-thermomechanically pulped.

In addition to hardwood fibers, the image layer pulp stock further includes a water soluble di-valent or multi-valent salt. The di-valent or multi-valent salt is present in an amount ranging from about 5 lb per ton of the amount of total fiber(s) in the image layer pulp stock to about 50 lb per ton of the amount of total fiber(s) in the image layer pulp stock. Some examples of the di-valent or multi-valent salt may include a salt of any metals of Group I, Group II, and Group III of the Periodic Table of Elements, as well as a salt of any of the transition metals. Some examples of metal cations include calcium ions, copper ions, nickel ions, magnesium ions, zinc ions, barium ions, iron ions, aluminum ions, and chromium ions; and some examples of anions for forming the metal salt include chloride ions, iodide ions, bromide ions, nitrate ions, phosphate ions, chlorate ions, acetate ions, propionates, formates, oxalates, and/or combinations thereof.

In an example, the di-valent or multi-valent salt may be chosen from calcium chloride ($CaCl_2$), magnesium chloride ($MgCl_2$), aluminum chloride ($AlCl_3$), magnesium sulfate ($MgSO_4$), calcium acetate ($Ca(CH_3COO)_2$), calcium propionate ($Ca(C_2H_5COO)_2$), calcium lactate ($C_6H_{10}CaO_6$), calcium nitrate ($Ca(NO_3)_2$), magnesium acetate ($Mg(CH_3COO)_2$), magnesium propionate ($Mg(C_2H_5COO)_2$), and combinations thereof.

When the image layer pulp stock includes less than 100 wt % of the hardwood fibers, the image layer pulp stock may also contain up to 10 wt % (with respect to total solids) of an additive. Suitable additives may be selected from the group consisting of a dry strength additive, wet strength additive, a filler, a retention aid, a dye, an optical brightening agent (i.e., optical brightener), a surfactant, a sizing agent, a biocide, a defoamer, and a combination thereof.

Examples of dry strength additives that may be added include anionic polyacrylamides, cationic polyacrylamides, amphoteric polyacrylamides, polyvinyl alcohol, cationized starch, vegetable galactomannan, and/or combinations thereof. Wet strength additives may be added, such as polyaminepolyamide epichlorohydrin resins.

Suitable fillers that may be added include carbonates (e.g., ground calcium carbonate and precipitated calcium carbonate), titanium dioxide, clays (e.g., kaolin clay), silicates, oxides, zeolites, talc, and combinations thereof.

Any suitable dye may be added, an example of which IRGALITE® Blue Dye (BASF Corp.).

Some suitable retention aids include polyacrylamide-based systems (such as PERCOL® polyacrylamides (BASF Corp.) and the Eka PL Series (Eka Chemicals, AkzoNobel Corp.), and solutions of particles and charged polymers (such as COMPOZIL® Select and Eka NP (Eka Chemicals, AkzoNobel Corp.).

Example optical brighteners include TINOPAL® ABP-A (BASF Corp.), and examples of suitable defoamers include AC-22 available from Performance Process, Inc., and ANTI-SPUMIN® 7100 available from Evonik-Degussa GmbH.

Some suitable surfactants include those of the Eka DPC Series, available from Eka Chemicals, AkzoNobel Corp.

Suitable sizing agents that may be added include fatty acids, metal salts of fatty acids, alkyl ketene dimer emulsification products, epoxidized higher fatty acid amides, alkenyl acid anhydride emulsification products and rosin derivatives, alkylsuccinic acid anhydride emulsification products and rosin derivatives, and/or combinations thereof.

Examples of suitable biocides include AQUATREAT® DNM 30 (AkzoNobel Corp), SPECTRUM™ XD3899 (Ashland, Inc.), and MYACIDE® AS and Protector) DZ (BASF Corp.).

The image layer pulp stock may be made by incorporating at least the hardwood fibers into a suitable amount of water to form a slurry. As an example, the slurry may contain 99% water and 1% fibers, where 100% of the fibers are the hardwood fibers disclosed herein. If the other fibers are included, they may be added into the slurry.

The slurry may be refined. In an example, a double disk refiner is used. The double disk refiner is a refining mechanism, which uses a free rotating disk rotor between two non-rotating disks. The rotating disk and the two non-rotating disks are each fit with a refining plate on each side thereof. The rotating disk, and associated refining plates rotate between the two non-rotating disks fit with refining plates. The refiner applies mechanical and hydraulic forces to alter the fibers within the slurry. For example, the refining process may cause one or more of the following: removal of the primary walls, formation of fiber debris, internal and external fibrillation, fiber shortening, and increased fiber flexibility within the slurry. Refining may be accomplished to achieve a desired freeness of pulp (e.g., targeting a certain number according to the Canadian Standard Method (CSF)). As an example, refining of the image layer pulp stock may be accomplished in a manner sufficient to target a CSF ranging from about 400 to about 450 for the hardwood fibers.

The salt (e.g., in solution form) and any additives can either be added to the slurry before or after refining.

After refining, the slurry may also be passed through a screen, which removes the larger debris but allows the fibers (and the additives and salt) to pass through the screen. The smaller unwanted particles that remain after the screening are removed by a centrifugal cleaner, which uses centrifugal force and fluid shear to remove the smaller unwanted particles. The smaller particles can be removed using this process, in part because the slurry components separate based on the particles weight and particle shape. This slurry (i.e., the image layer pulp stock) may be used in any examples of the method 100 shown in FIG. 1 to form examples of the image layer.

Examples of the pulp stock for the strength layer(s) include about 99% water. The remaining component in the strength layer(s) pulp stock is the softwood fibers. In some instances, no other components are added. In other instances, other fibers and/or additives may be included in the strength layer pulp stock.

The softwood fibers included in the strength layer pulp stock(s) have an average length ranging from about 1.5 mm to about 3.0 mm. The softwood fibers are present in an amount ranging from about 70 wt % to about 100 wt % of the solid components of the strength layer pulp stock. In an example, suitable softwood fibers include pulp fibers derived from coniferous trees (gymnosperms), such as varieties of fir, spruce, and pine (e.g., loblolly pine, slash pine, Colorado spruce, balsam fir, and Douglas fir).

When the strength layer pulp stock includes less than 100 wt % of the softwood fibers previously defined, the pulp stock may also include up to 30 wt % of other fibers other than the softwood fibers. These other fibers may be a different type of fiber as, but have the same length as, the softwood fiber. The other fibers may be natural fibers, virgin fibers, recycled fibers, non-deinkable fibers, unbleached fibers, synthetic fibers, mechanical fibers, or combinations thereof. In an example, the strength layer pulp stock may include a bulk of softwood fibers with a low level of hardwood, recycled, or other types of fibers, such as cellulose fibers.

The softwood fibers and/or other fibers may be prepared via any known pulping process, such as, for example, chemical pulping processes. Two suitable chemical pulping methods include the kraft process and the sulphite process. The softwood fibers may also be mechanically pulped, thermomechanically pulped, or chemi-thermomechanically pulped.

When the strength layer pulp stock includes less than 100 wt % of the softwood fibers, the image layer pulp stock may also contain up to 10 wt % (with respect to total solids) of an additive. In some instances, suitable additives for the strength layer pulp stock may include the dry strength additive, the wet strength additive, the filler, or a combination thereof. Any of the examples previously described may be used. In other instances, any of the additives (and amounts thereof) previously described for the image layer pulp stock may be used in the strength layer pulp stock.

The strength layer pulp stock may be made by incorporating at least the softwood fibers into a suitable amount of water to form a slurry. If the other fibers are included, they may be added into the slurry. As an example, the slurry may contain 99% water and 1% fibers, where 99% of the fibers are the softwood fibers disclosed herein and 1% of the fibers are other fibers.

In an example, the slurry may be refined. In another example, the slurry may not be refined. If the slurry is refined, the same process as previously described for the image layer slurry may be used. When the strength layer pulp stock is refined, the refining may be accomplished to achieve the desired freeness of pulp as described above (i.e., targeting a certain number according to the Canadian Standard Method (CSF)). As an example, refining of the strength layer pulp stock may be accomplished in a manner sufficient to target a CSF ranging from about 300 to about 500 for the softwood fibers.

Any other desirable additives may be added to the refined or unrefined slurry. In another example, the other additive(s) may be added as the slurry is refined. The strength layer slurry may also undergo the same screening and cleaning process previously described for the image layer slurry. This slurry (i.e., the strength layer pulp stock) may be used in any examples of the method 100 shown in FIG. 1 to form examples of the strength layer.

In the examples of the method 100 shown in FIG. 1, the strength and image layer pulp stocks are jetted from respective headboxes of a traditional papermaking machine. Prior to jetting, the respective pulp stocks are introduced into respective headboxes in a suitable manner.

In one example of the method 100, a packaging material with an image layer and a strength layer is formed. An example of this packaging material 20 is shown in FIG. 2. As depicted, the packaging material 20 includes the strength layer 24 having two opposed surfaces $S_1$, $S_2$ and the image layer 22 in contact with one of the opposed surfaces $S_1$ of the strength layer 24.

To make this example of the packaging material 20, the method 100 includes the step of jetting, from a first headbox, the strength layer pulp stock (shown as "first" pulp stock in FIG. 1) onto a wire to form a strength layer precursor. This is shown at step 102. The strength layer precursor is a wet web of at least the softwood fibers.

The method 100 also includes, at step 104, jetting, from a second headbox, the image layer pulp stock (shown as "second" pulp stock in FIG. 1) onto a second wire to form an image layer precursor. It is to be understood the wire upon which the strength layer precursor is formed is different than the second wire upon which the image layer precursor is formed. The image layer precursor is a wet web of at least the hardwood fibers and the salt.

Once the strength layer precursor and image layer precursor are formed, in the next step 126 of the method 100, the image layer precursor and strength layer precursor are placed into contact with each other. It is desirable that when the precursors are in contact, the image layer precursor should overlie the strength layer precursor. Placing the precursors in contact may be accomplished by moving the respective wires so that respective surfaces of the image layer precursor and the strength layer precursor are adjacent to one another and touch.

In some instances, it may be desirable to slightly dry (i.e., remove some of the water from) the strength layer precursor prior to placing the image layer precursor and the strength layer precursor in contact. In an example, water removal may be passive, where water is allowed to drain, filter, etc. from the strength layer precursor prior to applying the image layer precursor. Water removal may be accomplished so that the consistency (or concentration) is increased to a desirable level.

Consistency is defined as the weight in grams of oven-dry fiber in 100 grams of pulp-water mixture (i.e., pulp stock). To determine the consistency, TAPPI Test method TAPPI/ANSI T 240 entitled "Consistency (concentration) of pulp suspensions" may be used.

In an example, the consistency of the initial strength layer pulp stock is around 1% (e.g., including about 99% water and 1% solids). After jetting to form the strength layer precursor, the water begins to drain from the pulp stock, thereby increasing the consistency. It may be desirable to remove (e.g., by draining) a certain amount of the water from the strength layer precursor prior to bringing the image layer precursor in contact therewith. As such, the strength layer precursor may be exposed to drying (e.g., filtering, draining, etc.) in order to obtain a consistency ranging from about 5% to about 30%. Some specific examples of desirable strength layer precursor consistency levels (prior to image layer precursor application) include 5%, 10%, 15%, or 20° A. A higher consistency (i.e., less water in the strength layer precursor) may contribute to improving the salt retention in the image layer after the two precursors are put into contact. Since some water does remain in the strength layer precursor, it is still considered a wet web.

Due to the fact that the image layer precursor and the strength layer precursor are wet webs, this is a wet-on-wet process. This wet-on-wet process is advantageous, in part because subsequent papermaking steps (e.g., removing water, drying, etc.) do not have to be performed separately for each layer of the multi-layered structure. In addition to improving the efficiency of the method, the wet-on-wet process improves the adhesion between the layers by increasing bonding strength due to hydrogen bonding.

After the strength layer precursor and image layer precursor are placed in contact, the remaining water is removed from the image layer precursor and strength layer precursor (as shown at step 128). Some remaining water may be removed from the precursors in a press section of the papermaking machine. In an example, water removal is accomplished using rollers under high pressure. The precursors are passed between the rollers to squeeze out as much water as possible. Water removal may also be accomplished using a filtration process. It is to be understood that some water may remain in the precursors after the removal process takes place.

The orientation of the precursors during water removal is such that the image layer precursor overlies the strength layer precursor. This is desirable because the water drains generally in a direction toward the surface $S_2$ of the strength layer precursor. As the water is drained, salt from the image layer precursor may have a tendency to migrate with the water. However, the strength layer precursor aids in keeping most if not all of the salt from moving with the water. This is due, at least in part, to the strength layer low porosity fiber mat creating a barrier layer. The fiber mat enables at least the bulk of the salt to be maintained within the image layer precursor. As discussed above, increased dryness/consistency of the strength layer precursor before coming in contact with image layer precursor will also increase the salt retention. As such, salt retention may be at least partially controlled by controlling the consistency of the strength layer precursor.

Even though the bulk of the salt remains in the image layer precursor, some of the salt may still migrate through to the strength layer precursor. As such, the strength layer 24 that is ultimately formed may also contain some of the di-valent or multi-valent salt that migrated from the image layer precursor. However, it is to be understood that the di-valent or multi-valent salt present in the final image layer 22 is at least five times the amount of the di-valent or multi-valent salt present in the final strength layer 24.

The final step 130 of this example of method 100 includes drying the strength layer precursor and image layer precursor to form the packaging material, which includes the image layer 22 and the strength layer 24. Drying may be accomplished in any suitable manner. In an example, a series of steam heated drying cylinders are utilized, and the pressed precursors are passed around these cylinders. Drying removes excess water from the packaging material 20 that is formed; although it is to be understood that some water may still remain in the respective layers 22, 24.

While not shown in FIG. 1, the packaging material 20 may also be exposed to a calendering. Calendering may be performed in a typical manner, e.g., using heavy steel rollers. The rollers apply pressure to the passing packaging material 20 to smooth and/or enhance the gloss of the packaging material 20. One or more nips may be used in the calendering process.

While also not shown in FIG. 1, the packaging material 20 may also be exposed to a reeling process. In the reeling process, a reel is used to wind the packaging material 20 to form a roll.

As mentioned above, the process involving steps 102, 104, and 126-130 of FIG. 1 forms the packaging material 20 shown in FIG. 2. An example of image layer 22 may be formed from the image layer pulp stock including water, 100 wt % (with respect to solids in the pulp stock) unbleached hardwood fibers having the length within the range provided herein, $CaCl_2$ as the salt in an amount of 12 lb per ton of the total fiber in the image layer pulp stock, cationic starch as an additive in an amount of 20 lb per ton of the total fiber in the image layer pulp stock, and AKD (alkyl ketene dimer) as another additive in the amount of 5 lb per ton of the total fiber in the image layer pulp stock.

Another example of the image layer 22 may be formed from the image layer pulp stock including water, 70 wt % unbleached hardwood fibers having the length within the range provided herein, 30 wt % unbleached softwood fibers, $CaCl_2$ as the salt in an amount of 12 lb per ton of the total fiber in the image layer pulp stock, cationic starch as an additive in an amount of 20 lb per ton of the total fiber in the image layer pulp stock, and AKD as another additive in the amount of 5 lb per ton of the total fiber in the image layer pulp stock). An example of strength layer 24 of the packaging material 20 is formed from the strength layer pulp stock including water and 100 wt % unbleached softwood fibers having the length within the range provided herein.

In an example, one of the previously described image layer pulp stocks and strength layer pulp stock are jetted separately and put into contact. After the image layer pulp stocks and strength layer pulp stock are placed in contact, they are exposed to water removal, dried, and in some instances calendered/reeled as previously described to form the packaging material 20 having the layers 22, 24 adhered to one another. In another example, one of the previously described image layer pulp stocks and strength layer pulp stock are jetted separately and put into contact once the strength layer consistency (dryness) has reached a desirable level, e.g., 20%. After the image layer pulp stocks and strength layer pulp stock are placed in contact, they are exposed to further water removal through filtration, pressing and drying, and in some instances calendered/reeled as previously described to form the packaging material 20 having the layers 22, 24 adhered to one another. Alternatively, the image layer pulp stock may be jetted directly onto the strength layer pulp stock, and then the pulp stocks are exposed to water removal, drying, etc.

It is to be understood that the layers 22, 24 that are formed have approximately the same amount of the fibers, and in some instances salt and/or additives, which are used in the respective pulp stocks, taking into account minor loss due to the water removal process.

In another example of the method 100, another example of the packaging material is formed, with an image layer and two strength layers. An example of this packaging material 20' is shown in FIG. 3. As depicted, the packaging material 20' includes the strength layer 24 having the two opposed surfaces $S_1$, $S_2$, a second strength layer 24' in contact with one of the opposed surfaces $S_1$, and the image layer 22 in contact with the second strength layer 24'.

To make this example of the packaging material 20', step 102 may be performed, which forms the strength layer precursor (in this example, the precursor to strength layer 24). This step may be performed in the manner previously described.

The method 100 also includes step 106, where a strength layer pulp stock (referred to as the third pulp stock in box 106 in FIG. 1) is jetted from another (e.g., third) headbox onto another (e.g., third) wire to form a second strength layer precursor. This second strength layer precursor ultimately forms the second strength layer 24' shown in FIG. 3 (i.e., the middle layer of the multi-layered packaging material 20').

The second strength layer pulp stock (i.e., third pulp stock in FIG. 1) may include any of the components previously described for the strength layer pulp stock (used in step 102) and may be made by the same process. However, the second strength layer pulp stock may include from about 50 wt % to about 100 wt % of the softwood fibers having the length ranging from about 1.5 mm to about 3.0 mm. In an example, the strength layer pulp stock used to form strength layer 24 may be the same as the second strength layer pulp stock used to form the second strength layer 24'. For example, each of the strength layer pulp stocks may include the same type and amount of softwood fibers, with or without the same amount and type of additive(s). In another example, the strength layer pulp stock used to form strength layer 24 may be different than the second strength layer pulp stock used to form the second strength layer 24'. For example, the second strength layer pulp stock may include a different type and length of softwood fibers than are present in the strength layer pulp stock.

This example of the method 100 also includes step 104, which forms the image layer precursor (in this example, the precursor to image layer 22). This step may also be performed in the manner previously described.

The strength layer precursor, the second strength layer precursor, and the image layer precursor are then placed into contact with each other (as shown at step 108). It is to be understood that water from one or both of the strength layer precursors may be allowed to drain so that the precursor(s) have a desired consistency before being placed into contact with the image layer precursor.

It is desirable that when the precursors are in contact, the image layer precursor should overlie the strength and second strength layer precursors. Placing the precursors in contact may be accomplished by moving the respective wires so that respective surfaces of the image layer precursor and the second strength layer precursor are adjacent to one another and touch, and such that respective surfaces of the second strength layer precursor and the strength layer precursor are adjacent to one another and touch. In an example, the second strength layer precursor and the strength layer precursor may be placed into contact first by moving the corresponding wires into an appropriate position. Then the image layer precursor may be placed into contact with the exposed surface of the second strength layer precursor by moving at least the wire upon which the image layer precursor is formed adjacent to the exposed surface. The layering of the precursors is a wet-on-wet process.

The layered precursors form a stack, which includes the image layer precursor positioned as one of the outermost layers of the stack.

Step 110 of this example of the method 100 includes removing the water from the stack. Water removal may accomplished by any suitable process, including the use of high pressure and roller or filtration. In this example of the method 100, the orientation of the precursors during water removal is such that the image layer precursor overlies both the second strength layer precursor and the strength layer precursor. This is desirable because, as described above, the water drains generally in a direction toward the opposed surface $S_2$ of the strength layer precursor. As the water is drained, salt from the image layer precursor may have a tendency to migrate with the water. However, the softwood fibers, porosity, and consistency of the strength and second strength layer precursors keep most, if not all, of the salt from moving with the water by forming the fiber mat previously discussed.

Step 112 includes drying the stack of the image layer precursor, the second strength layer precursor, and the strength layer precursor to form the packaging material 20'.

While not shown in FIG. 1, the packaging material 20' may also be exposed to a calendering or reeling process, as described above.

As mentioned above, the process involving steps 102, 106, 104, and 108-112 of FIG. 1 forms the packaging material 20' shown in FIG. 3. An example of image layer 22 may be formed from the image layer pulp stock including water, 100 wt % bleached hardwood fibers having the length within the range provided herein, $CaCl_2$ as the salt in an amount of 12 lb per ton of the total fiber in the image layer pulp stock, cationic starch as an additive in an amount of 20 lb per ton of the total fiber in the image layer pulp stock, and AKD (alkyl ketene dimer) as another additive in the amount of 5 lb per ton of the total fiber in the image layer pulp stock.

An example of strength layer 24 of the packaging material 20' is formed from the strength layer pulp stock including water and 100 wt % unbleached softwood fibers having the length within the range provided herein. An example of strength layer 24' of the packaging material 20' is formed from the second strength layer pulp stock including water, 50 wt % recycled fibers, 50% bleached chemi-thermomechanical fibers. In another example, the second strength layer pulp stock may include the previously listed components as well as a dry strength additive, and may be formed without any refining.

In an example, the previously described image layer pulp stock, strength layer pulp stock, and one of the second strength layer pulp stocks are jetted separately and the precursors are put into contact (with or without altering the consistency of the strength layer precursor(s)), exposed to water removal, dried, and in some instances calendered/reeled as previously described to form the packaging material 20' having the layers 22, 24', 24 adhered to one another.

It is to be understood that the layers 22, 24', 24 that are formed have approximately the same amount of the fibers, and in some instances salt and/or additives, which are used in the respective pulp stocks, taking into account minor loss due to the water removal process.

In yet another example of the method 100 shown in FIG. 1, another example of the packaging material is formed, with an image layer, a strength layer (composed of two strength sub-layers in contact with one another), and a second image layer. An example of this packaging material 20" is shown in FIG. 4. As depicted, the packaging material 20" includes two strength sub-layers $\mathbf{24}_A$, $\mathbf{24}_B$ forming the strength layer 24, and respective image layers 22, 22' on opposed surfaces $S_1$, $S_2$ of the strength layer 24.

To make this example of the packaging material 20", two separate bi-layer structures are formed and then placed into contact with one another. One of the bi-layer structures is formed in steps 102, 104, 118, and 122; and another of the bi-layer structures is formed in steps 114, 116, 120, and 124.

To form one of the bi-layer structures, step 102 may be performed. This step may be performed as previously described. Step 102 forms the strength layer precursor, which in this example is a precursor to strength sub-layer $\mathbf{24}_A$ and a portion of strength layer 24. Step 104 may then be performed as previously described to generate the image layer precursor, which is a precursor to the image layer 22.

This example of the method 100 continues with step 118, where the image layer precursor (formed in step 104) and the strength layer precursor (formed in step 102) are placed into contact to form the bi-precursor structure. Prior to placing them in contact, the strength layer precursor (formed in step 102) may have its consistency increased in the manner previously described herein. Placing these precursors into contact may be accomplished as previously described in reference to step 126 of the first example of the method 100.

At step 122, water is removed from the bi-precursor structure in any suitable manner, such as those previously described in reference to step 130 of the first example of the method 100 disclosed herein. Orientation of the bi-precursor structure during water removal is such that the image layer precursor overlies the strength layer precursor. As previously described, this is desirable because the softwood fibers in the strength layer precursor keep most if not all of the salt from moving with the water out of the image layer precursor.

To form the other of the bi-layer structures, step 114 may be performed to generate a second strength layer precursor, which in this example is a precursor to strength sub-layer $\mathbf{24}_B$ and to another portion of strength layer 24. Since the strength sub-layer $\mathbf{24}_B$ and the strength sub-layer $\mathbf{24}_A$ make up portions of the same strength layer 24, it is desirable that the second strength layer pulp stock (i.e., third pulp stock in box 114 of FIG. 1) have the same composition as the strength layer pulp stock used to form the precursor to the strength sub-layer $\mathbf{24}_A$ (formed in step 102). As such, the second strength layer pulp stock (i.e., third pulp stock in box 114 of FIG. 1) may include any of the components previously described for the strength layer pulp stock (used in step 102) and may be made by the same process. It is to be understood however, that the second strength layer pulp stock may, in some instances, have a different type of softwood fiber than the strength layer pulp stock used to form the precursor to the strength sub-layer $\mathbf{24}_A$.

In step 114, the second strength layer pulp stock (i.e., third pulp stock in box 114 of FIG. 1) is jetted from another (e.g., third) headbox onto another (e.g., third) wire to form the second strength layer precursor.

Step 116 may then be performed to generate another image layer precursor. In step 116, the second image layer pulp stock (i.e., fourth pulp stock in box 116 of FIG. 1) is jetted from another (e.g., fourth) headbox onto another (e.g., fourth) wire to form the second image layer precursor.

This image layer precursor ultimately forms image layer 22'. The image layer precursor formed at step 116 may be made using any example of the image layer pulp stock described herein. If it is desirable the final image layer 22' have the same composition as the final image layer 22, then the image layer pulp stock used in step 104 may be the same as the image layer pulp stock (i.e., fourth pulp stock in box 116 of FIG. 1) used in step 116. However, if it is desirable that the final image layer 22' have a different composition than the final image layer 22, then the image layer pulp stock used in step 104 may be different than the image layer pulp stock (i.e., fourth pulp stock in box 116 of FIG. 1) used in step 116.

Generally, the image layer pulp stock (i.e., fourth pulp stock in box 116 of FIG. 1) used to form the second image layer precursor in this example of the method 100, may include water, hardwood fibers (having a length ranging from about 0.5 mm to about 1.5 mm) present in an amount ranging from about 70 wt % to about 100 wt % of total solids, salt, and if desirable, other fibers and/or additives. Suitable amounts for any of these components are previously described in reference to step 104.

This example of the method 100 continues with step 120, where the second image layer precursor (formed in step 116) and the second strength layer precursor (formed in step 114) are placed into contact to form the other bi-precursor structure. Prior to placing them in contact, the second strength layer precursor (formed in step 116) may have its consistency increased in the manner previously described herein. Placing these precursors into contact may be accomplished as previously described in reference to step 126 of the first example of the method 100.

At step 124, water is removed from the other bi-precursor structure in any suitable manner, such as those previously described in reference to step 130 of the first example of the method 100. Orientation of the bi-precursor structure during water removal is such that the second image layer precursor overlies the second strength layer precursor. As previously described, this is desirable because the softwood fibers in the second strength layer precursor keep most if not all of the salt from moving with the water out of the second image layer precursor.

Step 132 involves placing the bi-precursor structures in contact so that a stack is formed. The stack has the two strength layer precursors positioned so that they are adjacent to and touch one another. When the two strength layer precursors are in contact, precursors to the sub-layers $\mathbf{24}_A$ and $\mathbf{24}_B$ are formed. The precursors may be compressed together using rollers under high pressure and the resulting packaging material 20" may be considered to have a single strength layer 24. This process is similar to processing using a wet press.

Since the two strength layer precursors are in contact in the stack, each of the image layer precursors of the respective bi-precursor structure faces outward. This is desirable when dual-sided printing on the packaging material 20" is to be performed.

Step 134 includes drying the stack of the image layer precursor, the strength layer precursors, and the second image layer precursor to form the packaging material 20".

While not shown in FIG. 1, the packaging material 20" may also be exposed to a calendering or reeling process, as described above.

As mentioned above, the process involving steps 102, 104, 114-124, 132, and 134 of FIG. 1 forms the packaging material 20" shown in FIG. 4. An example of image layers 22, 22' may be formed from image layer pulp stocks including water, 100 wt % bleached hardwood fibers having the length within the range provided herein, $CaCl_2$ as the salt in an amount of 12 lb per ton of the total fiber in the image layer pulp stock, cationic starch as an additive in an amount of 20 lb per ton of the total fiber in the image layer pulp stock, and AKD (alkyl ketene dimer) as another additive in the amount of 5 lb per ton of the total fiber in the image layer pulp stock. The sub-layers $\mathbf{24}_A$, $\mathbf{24}_B$ of the strength layer 24 may be formed from a single strength layer pulp stock including water and 100 wt % unbleached softwood fibers having the length within the range provided herein.

In the examples of the method 100 disclosed herein, the number and types of pulp stocks that will be used will depend, at least in part, on which layers are desired in the final packaging material 20, 20', 20". In an example, the packaging material 20, 20', 20" will include at least the strength layer 24 and the image layer 22.

To further illustrate the present disclosure, an example is given herein. It is to be understood that this example is provided for illustrative purposes and is not to be construed as limiting the scope of the present disclosure.

EXAMPLE

Two samples of the packaging material disclosed herein were prepared along with a control sample. The control (sample 1), was Mottle White #3 media, which is a commercially available 2 layer packaging paper that does not include any salt. No salt was added to sample 1.

Samples 2 and 3 used the same Mottle White #3 media as the packaging material, except that $CaCl_2$ was added to one of the layers. The amount salt present in teach of samples 1-3 is shown in Table 1 below.

All three samples were tested for optical density after a 100 μL Fugu ink drawdown was performed using a Mayer Rod #8. Table 1 below shows the optical density results.

TABLE 1

| Sample ID | Formulation | Black Optical Density (KoD) after Fugu Ink Drawdown |
|---|---|---|
| Sample 1 | 0 lb/T of $CaCl_2$ | 0.95 |
| Sample 2 | 8.9 lb/T of $CaCl_2$ | 1.39 |
| Sample 3 | 30.3 lb/T of $CaCl_2$ | 1.58 |

The black optical density (KoD) was determined using an X-Rite densitometer. The higher KoD measurement demonstrates an improved printability on the packaging material. As shown in Table 1, samples 2 and 3 both had an improved printability with the addition of $CaCl_2$, as compared to sample 1 without any salt.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

It is to be understood that the ranges provided herein include the stated range and any value or sub-range within the stated range. For example, a range from about 50 wt % to about 100 wt % should be interpreted to include not only the explicitly recited limits of about 50 wt % to about 100 wt %, but also to include individual values, such as 60 wt %, 75 wt %, 90 wt %, etc., and sub-ranges, such as from about 65.5 wt % to about 95 wt %, from about 55 wt % to about 75 wt %, etc. Furthermore, when "about" is utilized to describe a value, this is meant to encompass minor variations (up to +/−10%) from the stated value.

While several examples have been described in detail, it will be apparent to those skilled in the art that the disclosed examples may be modified. Therefore, the foregoing description is to be considered non-limiting.

What is claimed is:

1. A method for making a packaging material, the method comprising:

jetting, from a first headbox, a first pulp stock onto a wire to form a strength layer precursor, the first pulp stock including:

water; and softwood fibers having an average length ranging from about 1.5 mm to about 3.0 mm, the softwood fibers present in the water in an amount ranging from about 70 wt % to about 100 wt % of a total solids wt % of the first pulp stock;

the first pulp stock excluding a water soluble di-valent or multi-valent salt;

jetting, from a second headbox, a second pulp stock onto a second wire to form an image layer precursor, the second pulp stock including:

water;

hardwood fibers having an average length ranging from about 0.5 mm to about 1.5 mm, the hardwood fibers present in the water in an amount ranging from about 70 wt % to about 100 wt % of a total solids wt % of the second pulp stock; and the water soluble di-valent or multi-valent salt present in an amount ranging from about 5 lb per ton of total fibers in the second pulp stock to about 50 lb per ton of the total fibers in the second pulp stock, and the water soluble di-valent or multi-valent salt being selected from the group consisting of magnesium sulfate, calcium propionate, calcium lactate, calcium nitrate, magnesium acetate, magnesium propionate, and combinations thereof;

placing the image layer precursor and the strength layer precursor in contact;

removing water from the image layer precursor and the strength layer precursor; and drying the image layer precursor and the strength layer precursor to form the packaging material including an image layer and a strength layer.

2. The method as defined in claim 1 wherein the first headbox and the second headbox are part of a paperboard duo Fourdrinier machine.

3. The method as defined in claim 1 wherein the method further comprises jetting, from a third headbox, a third pulp stock onto a third wire to form a second strength layer precursor, the third pulp stock including:

water; and second softwood fibers having an average length ranging from about 1.5 mm to about 3.0 mm, the second softwood fibers present in the water in an amount ranging from about 50 wt % to about 100 wt % of a total solids wt % of the third pulp stock;

the third pulp stock excluding the water soluble di-valent or multi-valent salt;

and wherein the image layer precursor, the strength layer precursor, and the second strength layer precursor are placed in contact to form a stack with the image layer precursor forming a first outer layer of the stack and the second strength layer forms a second outer layer of the stack, and wherein the drying step involves drying the stack.

4. The method as defined in claim 3 wherein prior to placing the image layer precursor, the strength layer precursor, and the second strength layer precursor in contact to form the stack, the method further comprises altering a consistency of any of the strength layer precursor or the second strength layer precursor to a consistency level ranging from about 5% to about 30%.

5. The method as defined in claim 3 wherein when the third pulp stock includes less than 100 wt % of the second softwood fibers, the third pulp stock further includes up to 50 wt % of recycled fibers other than the second softwood fibers.

6. The method as defined in claim 1 wherein the image layer precursor and the strength layer precursor in contact form a bi-precursor structure, and wherein the method further comprises:

jetting, from a third headbox, a third pulp stock onto a third wire to form a second strength layer precursor, the third pulp stock including:

water; and second softwood fibers having an average length ranging from about 1.5 mm to about 3.0 mm, the second softwood fibers present in the water in an amount ranging from about 50 wt % to about 100 wt % of a total solids wt % of the third pulp stock;

the third pulp stock excluding the water soluble di-valent or multi-valent salt;

jetting, from a fourth headbox, a fourth pulp stock onto a fourth wire, to form a second image layer precursor, the fourth pulp stock including:

water;

second hardwood fibers having an average length ranging from about 0.5 mm to about 1.5 mm, the hardwood fibers present in the water in an amount ranging from about 70 wt % to about 100 wt % of a total solids wt % of the third pulp stock; and a second water soluble di-valent or multi-valent salt present in an amount ranging from about 5 lb per ton of total fibers in the fourth pulp stock to about 50 lb per ton of the total fiber in the fourth pulp stock; and placing the second image layer precursor and the second strength layer precursor in contact to form a second bi-precursor structure;

removing water from the second bi-precursor structure;

prior to the drying of the image layer precursor and the strength layer precursor, placing the bi-precursor structure and the second bi-precursor structure into contact to form a stack having the strength layer precursor of the bi-precursor structure and the second strength layer precursor of the second bi-precursor structure in contact with one another; and drying the stack, thereby performing the step of drying the image layer precursor and the strength layer precursor.

7. The method as defined in claim 6 wherein prior to placing the image layer precursor and the strength layer precursor in contact to form the bi-precursor structure, the method further comprises altering a consistency of the strength layer precursor to a consistency level ranging from about 5% to about 30%.

8. The method as defined in claim 6 wherein prior to placing the second image layer precursor and the second strength layer precursor in contact to form the second bi-precursor structure, the method further comprises altering a consistency of the second strength layer precursor to a consistency level ranging from about 5% to about 30%.

9. The method as defined in claim 1 wherein prior to placing the image layer precursor and the strength layer precursor in contact, the method further comprises altering a consistency of the strength layer precursor to a consistency level ranging from about 5% to about 30%.

10. The method as defined in claim 1 wherein the second pulp stock includes less than 100 wt % of the hardwood fibers, and the second pulp stock further includes a dry strength additive selected from the group consisting of anionic polyacrylam ides, cationic polyacrylam ides, amphoteric polyacrylam ides, polyvinyl alcohol, cationized starch, vegetable galactomannan, and combinations thereof.

11. The method as defined in claim 1 wherein the second pulp stock includes less than 100 wt % of the hardwood fibers, and the second pulp stock further includes a polyaminepolyamide epichlorohydrin resin.

12. The method as defined in claim 1 wherein recycled fibers are included in at least one of the first pulp stock or the second pulp stock.

13. The method as defined in claim 1 wherein when the second pulp stock includes less than 100 wt % of the hardwood fibers, the second pulp stock further includes one of:

up to 20 wt % of other fibers other than the hardwood fibers; or up to 10 wt % of an additive selected from the group consisting of a dry strength additive, a wet strength additive, a filler, a retention aid, a dye, an optical brightening agent, a sizing agent, a biocide, a defoamer, a surfactant, and a combination thereof; or up to 20 wt % of other fibers other than the hardwood fibers and up to 10 wt % of an additive selected from the group consisting of a dry strength additive, a wet strength additive, a filler, a retention aid, a dye, an optical brightening agent, a sizing agent, a biocide, a defoamer, a surfactant, and a combination thereof.

14. The method as defined in claim 1 wherein when the first pulp stock includes less than 100 wt % of the softwood fibers, the first pulp stock further includes up to 30 wt % of other fibers other than the softwood fibers.

15. A method for making a packaging material, the method comprising:

jetting, from a first headbox, a first pulp stock onto a wire to form a strength layer precursor, the first pulp stock including:

water; and softwood fibers having an average length ranging from about 1.5 mm to about 3.0 mm, the softwood fibers present in the water in an amount ranging from about 70 wt % to about 100 wt % of a total solids wt % of the first pulp stock;

the first pulp stock excluding a water soluble di-valent or multi-valent salt;

jetting, from a second headbox, a second pulp stock onto a second wire to form an image layer precursor, the second pulp stock consisting of:

water;

hardwood fibers having an average length ranging from about 0.5 mm to about 1.5 mm, the hardwood fibers present in the water in an amount ranging from about 70 wt % to about 100 wt % of a total solids wt % of the second pulp stock; and the water soluble di-valent or multi-valent salt present in an amount ranging from about 5 lb per ton of total fibers in the second pulp stock to about 50 lb per ton of the total fibers in the second pulp stock, and the water soluble di-valent or multi-valent salt being selected from the group consisting of magnesium sulfate, calcium propionate, calcium lactate, calcium nitrate, magnesium acetate, magnesium propionate, and combinations thereof;

placing the image layer precursor and the strength layer precursor in contact;

removing water from the image layer precursor and the strength layer precursor; and drying the image layer precursor and the strength layer precursor to form the packaging material including an image layer and a strength layer.

* * * * *